US008918266B2

(12) United States Patent
Weiss et al.

(10) Patent No.: US 8,918,266 B2
(45) Date of Patent: Dec. 23, 2014

(54) METHOD FOR THE AUTOMATIC LAMBDA CONTROL OF AN INTERNAL COMBUSTION ENGINE

(75) Inventors: Tobias Weiss, Herbertingen (DE); Michael Hönl, Ravensburg (DE); Matthias Schweitzer, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 373 days.

(21) Appl. No.: 13/234,689

(22) Filed: Sep. 16, 2011

(65) Prior Publication Data

US 2012/0072094 A1 Mar. 22, 2012

(30) Foreign Application Priority Data

Sep. 16, 2010 (DE) ..... 10 2010 045 684

(51) Int. Cl.

| | |
|---|---|
| ***F02D 45/00*** | (2006.01) |
| ***F02D 41/12*** | (2006.01) |
| ***F02D 41/24*** | (2006.01) |
| *F02D 41/14* | (2006.01) |

(52) U.S. Cl.

CPC ..... *F02D 41/123* (2013.01); *F02D 41/2454* (2013.01); *F02D 41/1456* (2013.01)

USPC ..... 701/103; 710/110

(58) Field of Classification Search

USPC ..... 701/102–105, 107, 109, 112–115; 123/179.5, 198 D, 198 DB, 198 DC, 123/198 F, 339.12, 339.14, 320, 325, 352, 123/481, 493, 496, 503, 67, 680, 687, 689

See application file for complete search history.

(56) References Cited

U.S. PATENT DOCUMENTS

| | | | | |
|---|---|---|---|---|
| 4,237,833 | A * | 12/1980 | Des Lauriers | 123/320 |
| 5,211,154 | A * | 5/1993 | Brandt | 123/693 |
| 6,227,033 | B1 | 5/2001 | Kainz | |
| 6,237,575 | B1 * | 5/2001 | Lampert et al. | 123/520 |
| 6,789,533 | B1 * | 9/2004 | Hashimoto et al. | 123/672 |
| 7,340,945 | B2 * | 3/2008 | Tashiro | 73/114.72 |
| 7,584,642 | B2 | 9/2009 | Michalske et al. | |
| 8,108,130 | B2 * | 1/2012 | Scheuerer | 701/109 |
| 8,157,035 | B2 * | 4/2012 | Whitney et al. | 180/65.265 |
| 2009/0095049 | A1 * | 4/2009 | Graupner et al. | 73/1.07 |
| 2009/0145778 | A1 * | 6/2009 | Allmendinger | 205/789 |
| 2009/0164091 | A1 * | 6/2009 | Kobayashi et al. | 701/102 |
| 2009/0281710 | A1 * | 11/2009 | Mallebrein et al. | 701/104 |
| 2012/0167656 | A1 * | 7/2012 | Verdier et al. | 73/1.06 |

FOREIGN PATENT DOCUMENTS

| | | |
|---|---|---|
| DE | 102004048136 | 4/2006 |
| DE | 102005056152 | 5/2007 |
| DE | 102006010905 | 9/2007 |
| DE | 102008044051 | 5/2010 |

* cited by examiner

*Primary Examiner* — John Kwon
*Assistant Examiner* — Johnny H Hoang
(74) *Attorney, Agent, or Firm* — Lucas & Mercanti, LLP; Klaus P. Stoffel

(57) ABSTRACT

A method for automatic lambda control of an internal combustion engine, in which, upon detection of a predetermined operating state of the internal combustion engine, a calibration factor (KAL) is determined and in which, during the operation of the internal combustion engine, a lambda measuring signal (iP) is corrected by the calibration factor (KAL) and is set as the actual lambda value (Lam(IST)) for the automatic lambda control of the internal combustion engine. The predetermined operating state is recognized when an engine coastdown is initiated.

13 Claims, 7 Drawing Sheets

METHOD FOR THE AUTOMATIC LAMBDA CONTROL OF AN INTERNAL COMBUSTION ENGINE

CROSS-REFERENCE TO RELATED APPLICATIONS

The present application claims priority of DE 10 2010 045 684.5-26, filed Sep. 16, 2010, the priority of this application is hereby claimed and this application is incorporated herein by reference.

BACKGROUND OF THE INVENTION

The invention concerns a method for the automatic lambda control of an internal combustion engine.

To maintain the legal pollutant limits, an internal combustion engine is automatically controlled to a set lambda value. In this closed-loop control system, a pump current of the lambda sensor is determined as a measured value. This is then converted to an actual lambda value and compared with the set lambda value to obtain a lambda control deviation. A lambda controller then uses the lambda control deviation to compute the control signal, for example, a set injection quantity, with which an injector is then activated. Based on the raw environment in the exhaust gas tract of the internal combustion engine, the lambda sensor ages over its operating time, so that the signal of the measured value changes. However, to achieve high precision, the lambda sensor must be calibrated at regular intervals, for example, after about 24 hours of operation.

DE 10 2005 056 152 A1 discloses a method for calibrating a lambda sensor. When a predetermined operating state of the internal combustion engine is detected, a correction value for adjusting the measured value is determined. The adjusted measured value then corresponds to the actual lambda value. The predetermined operating state is defined as the state in which the injection is deactivated and the speed of the internal combustion engine is above a threshold engine speed, in other words, during a shifting operation of the internal combustion operation or a coasting phase of the vehicle. However, the method is thus limited to a vehicle application, for example, an automobile or truck. In so-called off-road applications, for example, in an internal combustion engine that drives a bagger or a pump for delivering oil, there is no coasting phase. Therefore, the method described above cannot be used for these applications.

SUMMARY OF THE INVENTION

Therefore, the objective of the invention is to develop a method for automatic lambda control with calibration of the lambda sensor that can be used in off-road applications.

The method of the invention thus includes in the determination of the calibration factor for correcting the lambda measuring signal during engine coastdown. In a first embodiment of this, the injection is deactivated upon initiation of the engine coastdown, for example, via an engine stop signal. In a second embodiment, upon initiation of the engine coastdown, the engine speed is first temporarily increased from an idle speed to a calibrating speed. After the expiration of a time interval, the injection is then deactivated as in the first embodiment. The temporary increase in engine speed prolongs the engine coastdown phase, and as a result a greater air volume flow is available for the calibration of the lambda sensor. Therefore, this has the advantage of more precise calibration.

In both embodiments, upon initiation of the engine coastdown, a time window is set, in which a maximum value of the lambda measuring signal is determined. The time window ends when the engine speed falls below a threshold value. In practice, the threshold value can even be zero revolutions per minute. As error protection, it is provided that the maximum value is weighted with respect to a tolerance range. If it lies within the tolerance range, the maximum value is set as a permissible value and further processed. If, on the other hand, it lies outside the tolerance range, it is set as an impermissible value, discarded as a data value, and stored as an error in an error counter. The count is monitored. In the case of a maximum value that has been set as a permissible value, it is compared with a nominal value by taking the quotient, which is then set as the calibration factor.

The invention offers the advantage that the calibration of a lambda sensor is made possible even for internal combustion engines without coasting operation and without additional devices. This makes automatic lambda control of these internal combustion engines possible for the first time. Tests showed that the method of the invention is significantly more exact than a method without calibration. In addition, the method is robust with respect to changes in engine load and with respect to different lambda sensors.

The various features of novelty which characterize the invention are pointed out with particularity in the claims annexed to and forming a part of the disclosure. For a better understanding of the invention, its operating advantages, specific objects attained by its use, reference should be had to descriptive matter in which there are described preferred embodiments of the invention.

DETAILED DESCRIPTION OF THE INVENTION

Figure 1:
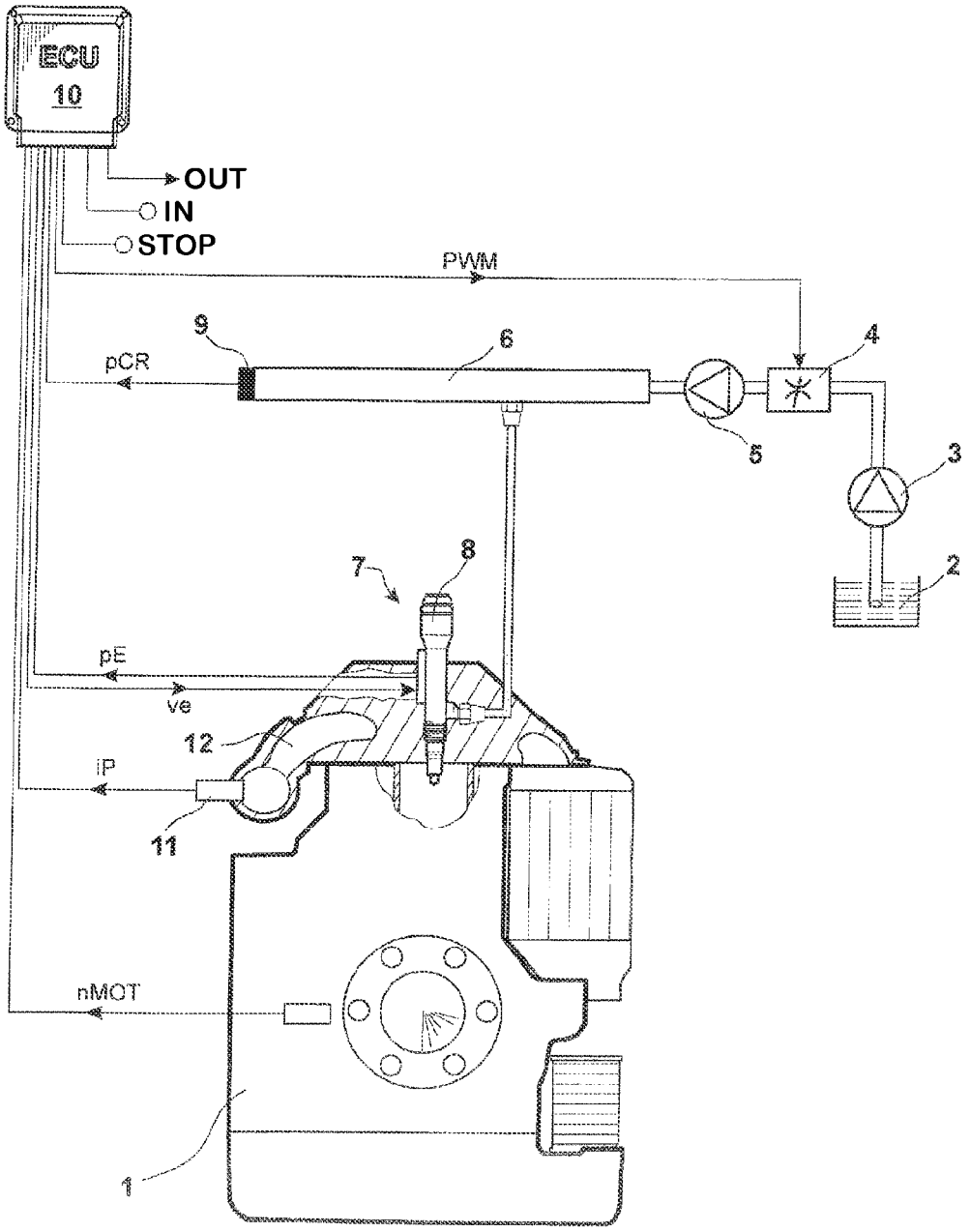
FIG. 1 shows a system diagram.

FIG. 1 shows a system diagram of an electronically controlled internal combustion engine 1 with a common rail system. The common rail system comprises the following mechanical components: a low-pressure pump 3 for pumping fuel from a fuel tank 2, a suction throttle 4 for controlling the volume flow, a high-pressure pump 5, a rail 6, and injectors 7 for injecting fuel into the combustion chambers of the internal combustion engine 1. Optionally, the common rail system can also be provided with individual accumulators, in which case an individual accumulator 8 is then integrated, for example, in the injector 7 as an additional buffer volume.

The internal combustion engine 1 is controlled by an electronic engine control unit (ECU) 10, which contains the usual components of a microcomputer system, for example, a microprocessor, interface adapters, buffers and memory components (EEPROM, RAM). Operating characteristics that are relevant to the operation of the internal combustion engine 1 are applied in the memory components in the form of input-output maps/characteristic curves. The electronic control unit 10 uses these to compute the output variables from the input variables. FIG. 1 shows the following input variables of the electronic engine control unit 10 as examples: a rail pressure pCR, the engine speed nMOT, the pump current iP of the lambda sensor 11, an engine stop signal STOP, and an input variable IN. The rail pressure pCR is determined by a rail pressure sensor 9. The oxygen concentration in the exhaust gas of the internal combustion engine 1 is determined by the lambda sensor 11, which is arranged directly in the exhaust gas tract 12 or in a bypass of the exhaust gas tract of the internal combustion engine 1. The variable IN is representative of the other input signals, for example, a power desired by the operator. If the common rail system is equipped with individual accumulators, then the individual accumulator pressure pE is another input variable of the electronic engine control unit 10. The illustrated output variables of the electronic control unit 10 are a PWM signal PWM for controlling the suction throttle 4, a power-determining signal ve (injection start, injection end) for controlling the injectors 7, and an output variable OUT, which represents additional control signals for automatically controlling the internal combustion engine 1, for example, a control signal for controlling an EGR valve.

Figure 2:
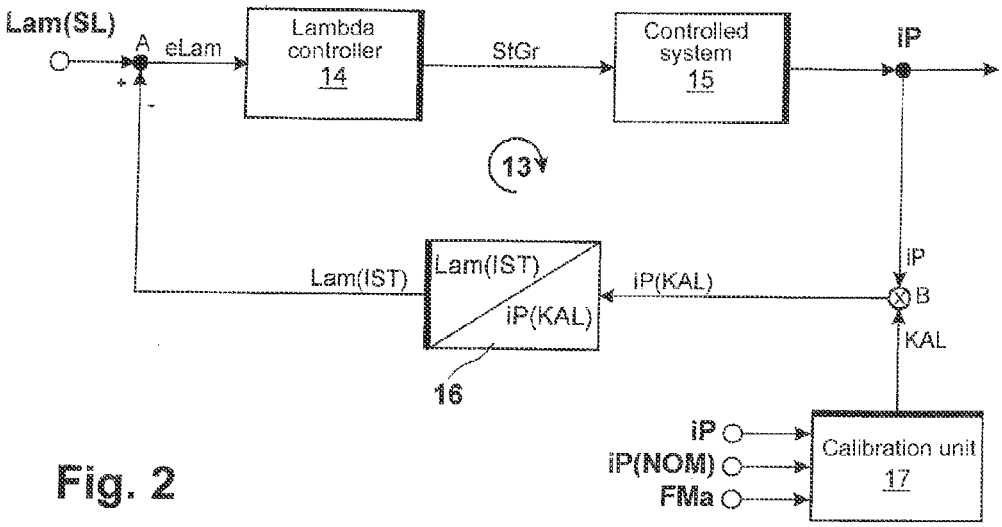
FIG. 2 shows a functional block diagram of the lambda closed-loop control system.

FIG. 2 shows a lambda closed-loop control system 13, whose input variable, i.e., the reference input, is a set lambda Lam(SL). The output variable is the raw value of the pump current iP of the lambda sensor, which varies as a function of the oxygen concentration in the exhaust gas tract. The actual lambda Lam(IST) is then determined by a computing unit 16 as a function of the pump current iP. The set lambda Lam(SL) is compared with the actual lambda Lam(IST) at a summation point A to obtain a lambda control deviation eLam. A lambda controller 14 with at least PI action uses the control deviation eLam to determine the correcting variable StGr. The correcting variable StGr corresponds, for example, to a set injection quantity, unit: cubic millimeters/stroke, to a set air mass, or to a set charge pressure in the air intake of the internal combustion engine 1. The correcting variable StGr then activates the corresponding actuator, for example, the injector, in the controlled system 15. The closed-loop control system is thus closed.

The lambda closed-loop control system 13 is supplemented by a calibration unit 17 and a multiplication point B. The input variables of the calibration unit 17 are the pump current iP, a nominal pump current iP(NOM), and an engine coastdown enabling signal FMa. The calibration unit 17 will now be explained with reference to the functional block diagram in FIG. 3. The calibration unit 17 computes a calibration factor KAL when a predetermined operating state of the internal combustion engine is detected. The predetermined operating state is an initiated engine coastdown. During the normal operation of the internal combustion engine, the value of the pump current iP is then multiplied by the calibration factor KAL (multiplication point B). The result is the corrected pump current iP(KAL), which is the input variable of the computing unit 16.

Figure 3:
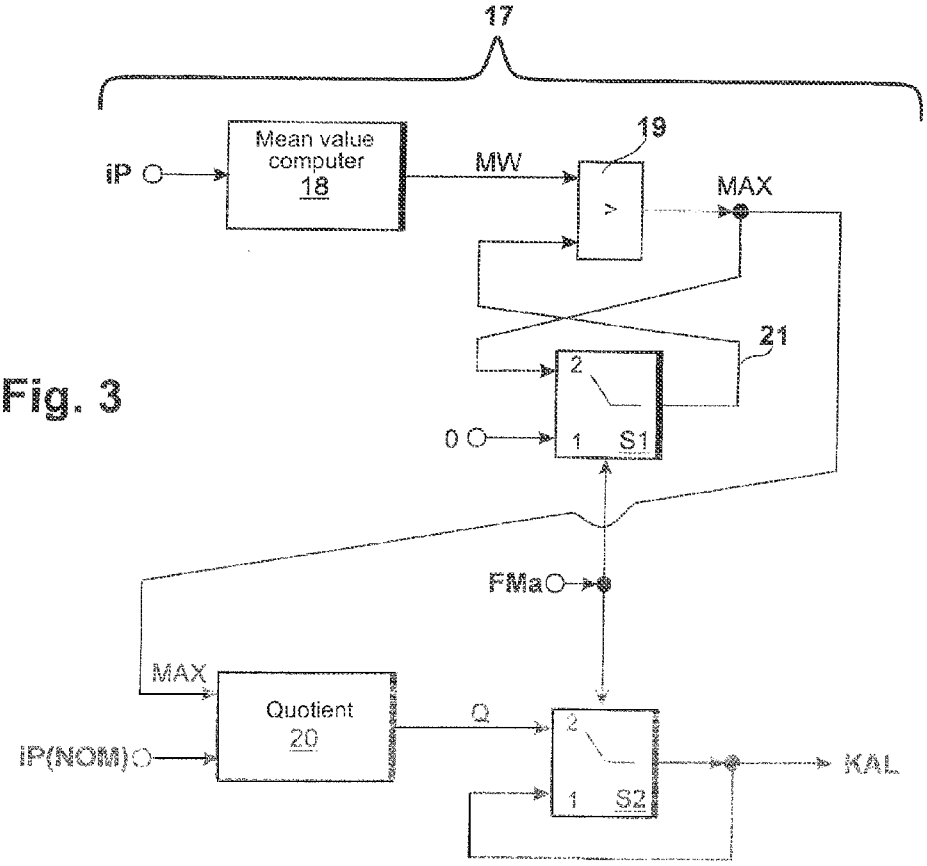
FIG. 3 shows a functional block diagram of the calibration unit.

In FIG. 3, the calibration unit 17 is shown as a functional block diagram. The input variables are the pump current iP, a nominal pump current iP(NOM), and the engine coastdown enabling signal FMa. The output variable is the calibration factor KAL for correcting the pump current iP (see FIG. 2). The calibration unit contains the following: a (continuous) mean value computer 18, a comparator 19, a quotient former 20, a switch S1, and a switch S2. The switching state of the two switches S1 and S2 is determined by the value of the engine coastdown enabling signal FMa. If the engine coastdown enabling signal is not set, corresponding to a logic zero (FMa=0), then the two switches S1 and S2 are in position 1. On the other hand, if the engine coastdown enabling signal is set, corresponding to a logic one (FMa=1), then the two switches S1 and S2 occupy position 2. In FIG. 3, therefore, the state is shown with engine coastdown set.

During the normal operation of the internal combustion engine, the engine coastdown enabling signal is not set (FMa=0). Therefore, the switch S1 is in position 1 (S1=1). This value is supplied to a first input of the comparator 19 via a feedback 21. The mean value MW of the pump current iP is determined by the mean value computer 18 and supplied to the second input of the comparator 19. Therefore, the mean value MW is set by the comparator 19 as the output variable MAX. The output variable MAX is fed back to the switch S1 and is also fed to the quotient former 20. Due to the position of the switch S1 (S1=1), the output value MAX has no effect on the output value of the switch S1. A constant data value is supplied at the second input of the quotient former 20 (here: the nominal pump current iP(NOM)). The nominal pump current is characteristic of the lambda sensor that is used, for example, iP(NOM)=1.022. The output variable Q of the quotient former 20 is supplied to the input 2 of the switch S2. Since the switch S2 is in position 1 (S2=1), the output variable Q is not further processed, i.e., the calibration factor KAL remains unchanged.

If an engine coastdown is then initiated, the engine coastdown enabling signal FMa is set (FMa=1). With the setting of the enabling signal, the switch S1 and the switch S2 switch to position 2 (S1=2, S2=2). The calibration factor KAL then follows the output variable Q of the quotient former 20, with the output variable Q being determined by the maximum value of the pump current iP that arises. In other words, the pump current iP of the lambda sensor is evaluated with respect to extrema after the end of injection. The absolute maximum after the end of injection is used for the calibration of the measuring signal. The ratio of this maximum to the theoretical value iP(NOM) is then taken to obtain the calibration factor KAL, with which the lambda sensor signal (pump current iP) is corrected during engine operation.

Figure 4:
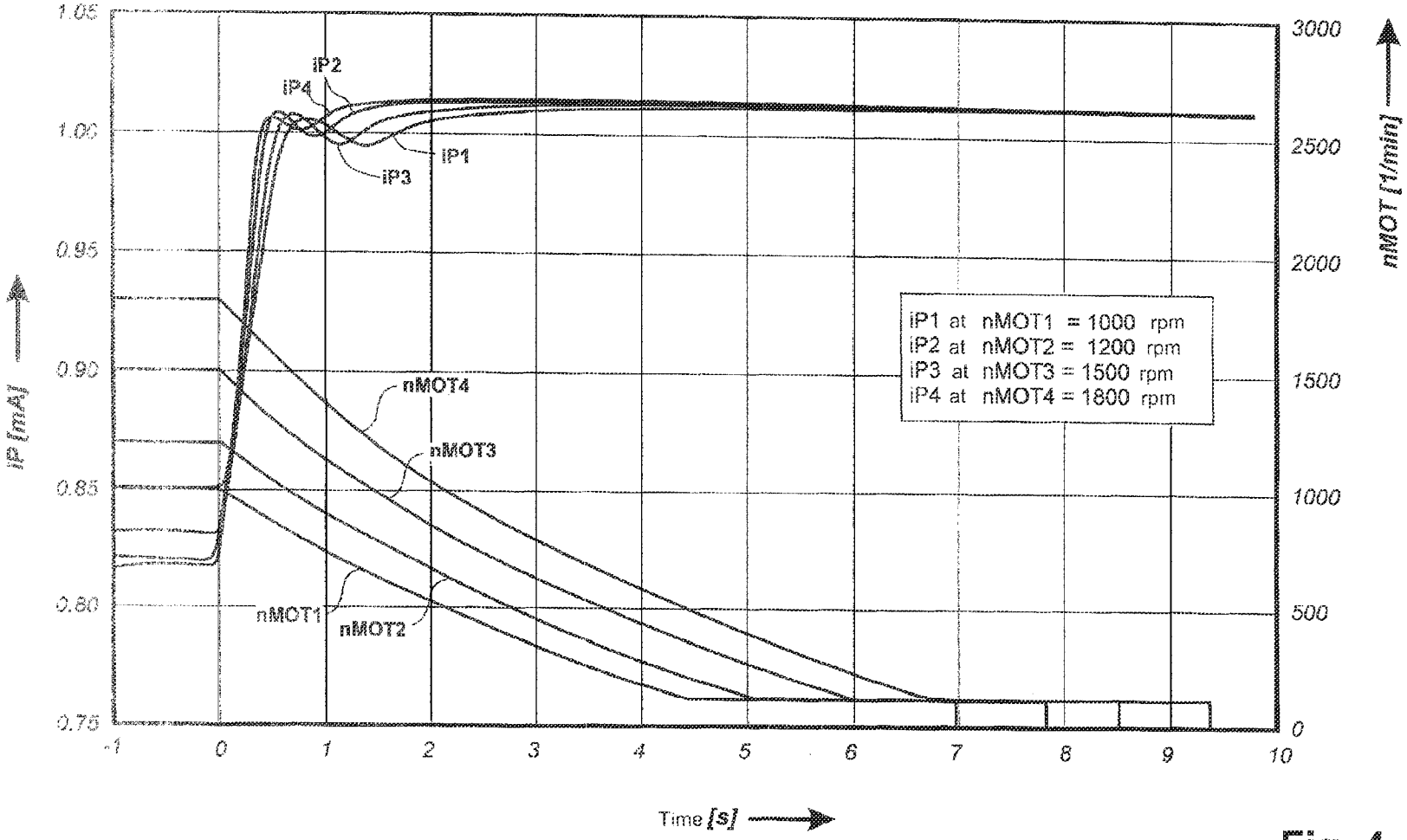
FIG. 4 shows a time chart of an engine coastdown.

FIG. 4 shows a time chart of an engine coastdown without temporary speed increase. The time in seconds is plotted on the x-axis. The pump current iP in milliamperes is plotted on the y-axis on the left side of the chart, and the engine speed nMOT in revolutions per minute is plotted on the y-axis on the right side of the chart. Four engine speed curves nMOT1 to nMOT4 are plotted on the chart, and corresponding pump current curves iP1 to iP4 are plotted along with these engine speed curves. Thus, the pump current curve iP1 is correlated with the engine speed nMOT1 with a starting value of nMOT1=1000 rpm. The general relationship will be explained, by way of example, on the basis of the engine speed curve nMOT3.

At starting time t=−1, the engine speed nMOT3=1500 rpm, which represents the starting value. At time t=0, an engine coastdown is initiated, for example, by means of a stop button, and is recognized as a predetermined engine state for the determination of the calibration factor. Upon initiation of the engine coastdown, injection is deactivated. Since fuel is no longer being injected, the engine speed nMOT3 starts to drop, and the exhaust gas tract is flushed with pure air. Accordingly, the pump current iP3 rises very sharply, overshoots the value iP=1 mA and stabilizes at a value of iP=1.022 mA after the time t=2 s. The engine speed nMOT3 decreases until about time t=7 s and then falls below a threshold value GW, for example, GW=100 rpm. When the engine speed falls below this threshold value, the internal combustion engine is deactivated (engine stop).

Figure 5:
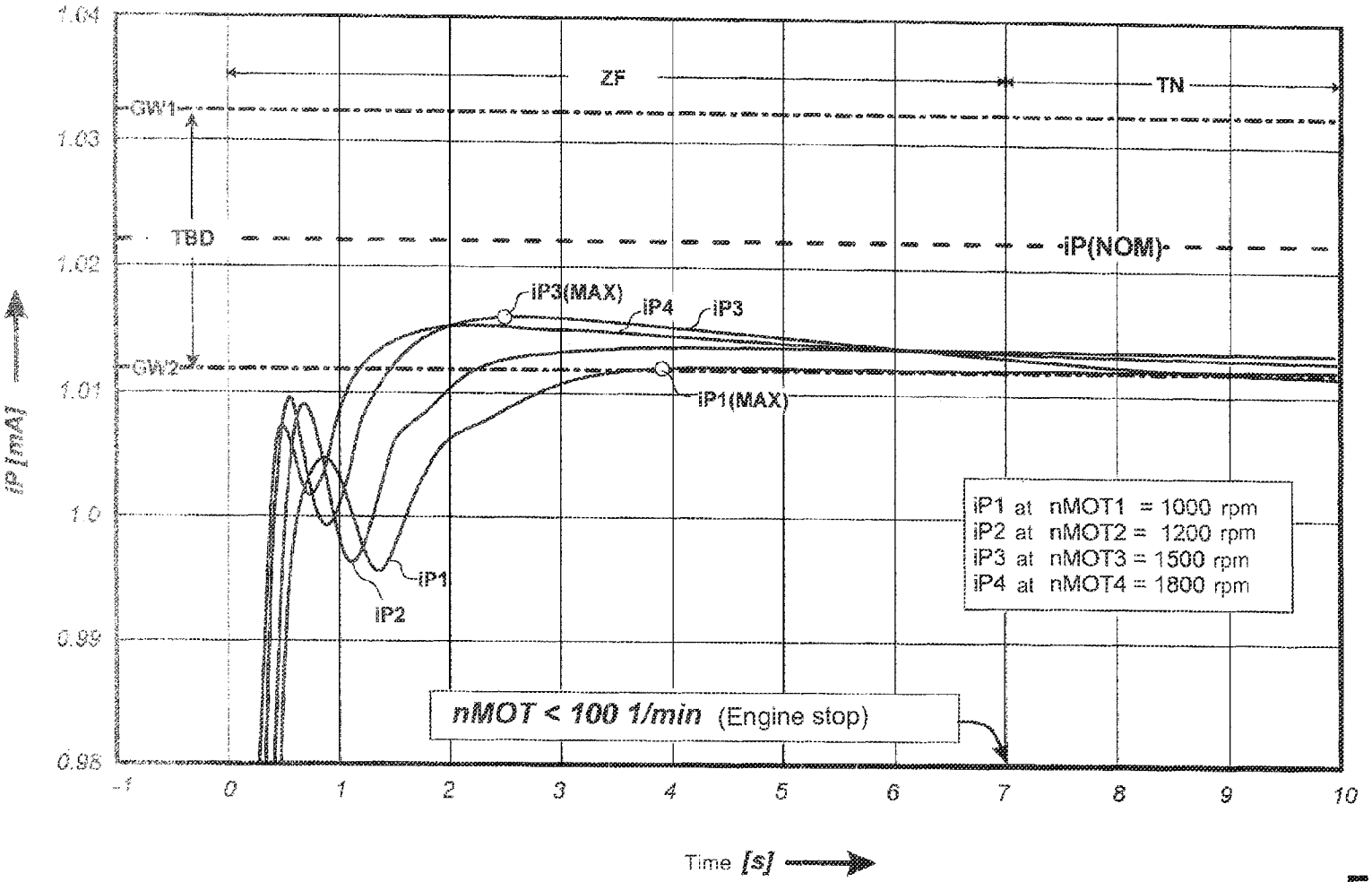
FIG. 5 shows a segment of FIG. 4.

The method of the invention is explained with reference to FIG. 5, which shows an enlarged segment of FIG. 4. In addition, FIG. 5 shows a tolerance range TBD bounded by the two dot-dash lines GW1 and GW2 and a time window ZF. Upon initiation of the engine coastdown (t=0), the time window ZF is set. The end of the time window ZF is set when the engine speed nMOT falls below the threshold value GW. Additionally, a shut-off delay time TN can be provided. In this case, the end of the time window is set when the engine speed nMOT falls below the threshold value GW and the shut-off delay time TN has elapsed. In practice, the threshold value can also be GW=0 rpm. For the lambda measuring signal, i.e., the measured pump current iP, the maximum value is determined within the time window ZF. For example, for the pump current iP3, this is the value iP3(MAX). Since this value iP3(MAX) lies within the tolerance range TBD, the maximum value iP3(MAX) is set as a permissible value and further processed. In a next step, the maximum value iP3(MAX) is divided by the nominal value iP(NOM), which characterizes the lambda sensor that is used. This quotient (FIG. 3: Q) represents the calibration factor (FIG. 3: KAL). If the determined maximum value of the pump current lies outside the tolerance range, the maximum value is set as an impermissible value. An error counter is then increased by one.

As FIG. 5 also shows, the pump currents iP1 to iP4 differ from one another only slightly. In other words, the effect of the starting speed (see box in FIG. 5) on the method of the invention is very small.

Figure 6:
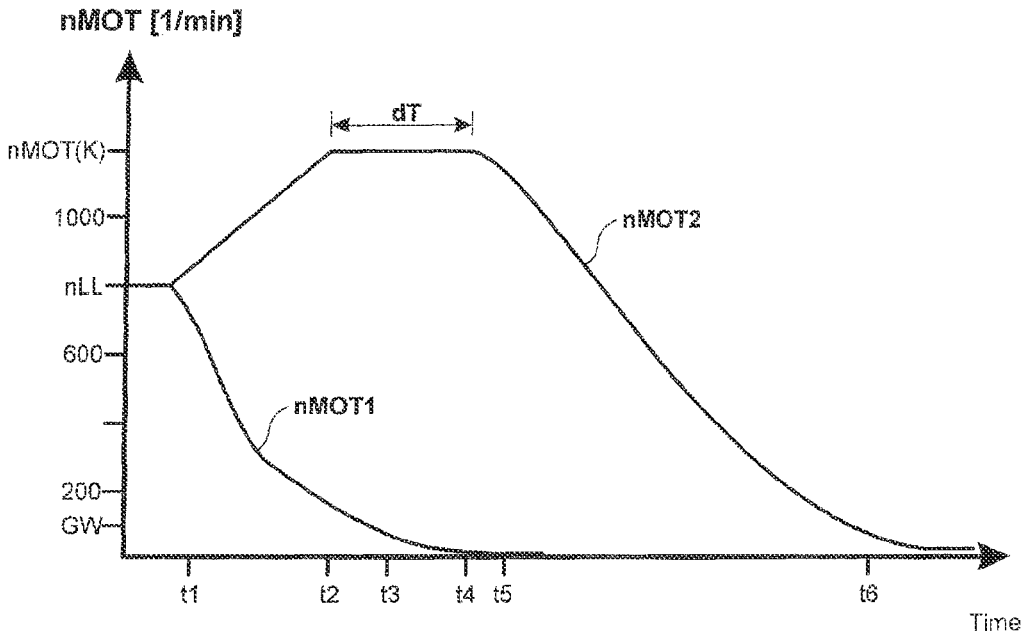
FIG. 6 shows an engine speed curve.

FIG. 6 shows a graph of speed as a function of time. The speed curve nMOT1 characterizes a first embodiment, in which, after initiation of the engine coastdown, injection is immediately deactivated. The speed curve nMOT2 characterizes a second embodiment, in which, after initiation of the engine coastdown, the engine speed is first temporarily increased and then injection is deactivated. At time t1 an engine coastdown is initiated. In the first embodiment, injection is deactivated upon initiation of the engine coastdown. Accordingly, starting from time t1, the engine speed nMOT1 falls from the idle speed nLL and approaches a threshold value, here: GW=100 rpm, at which the internal combustion engine can be regarded as deactivated (t5). In the second embodiment, after initiation of the engine coastdown, at first more fuel is injected. Therefore, the engine speed nMOT2 increases from the idle speed nLL. At time t2 the engine speed nMOT2 has reached a calibration speed nMOT(K)=1200 rpm. After a time interval dt has elapsed, here: time interval t2/t4, injection is deactivated, so that the engine speed nMOT2 drops. The temporary increase in the engine speed has the effect of prolonging the engine coastdown phase, and as a result a greater air volume flow is available for the calibration of the lambda sensor. This has the advantage of more precise calibration.

Figure 7:
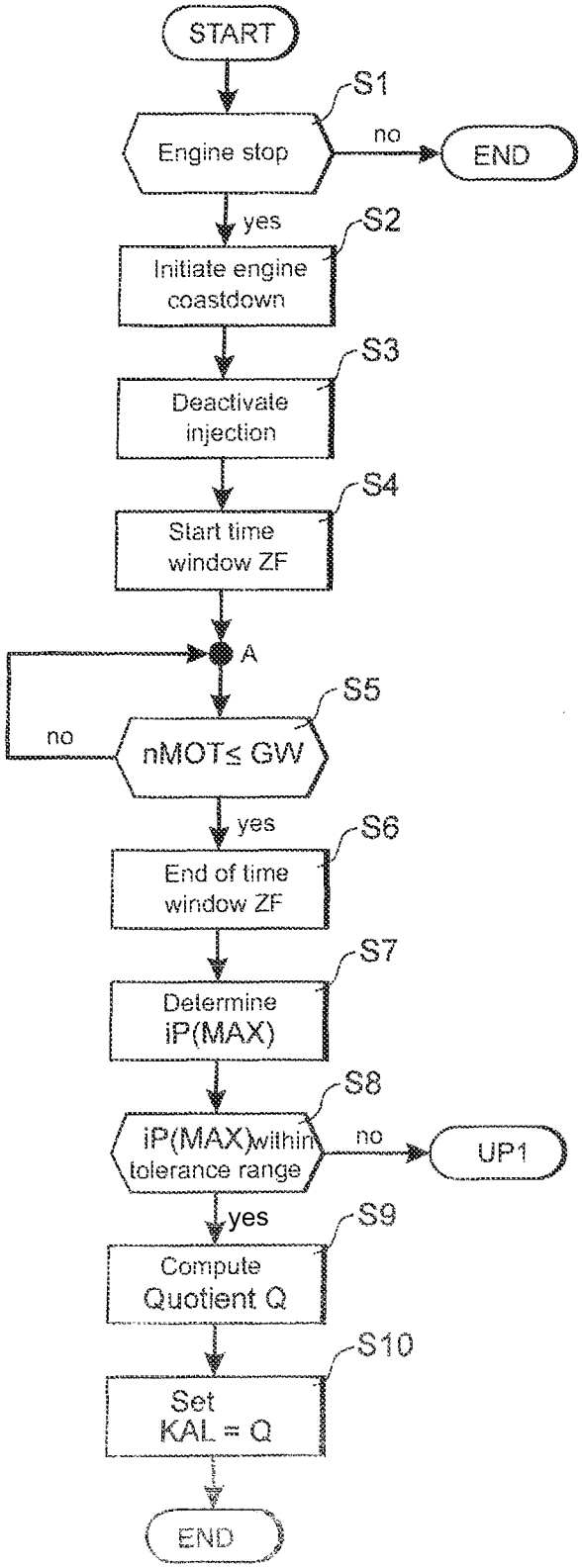
FIG. 7 shows a first program flowchart (1st and 2nd embodiment).
Figure 8:
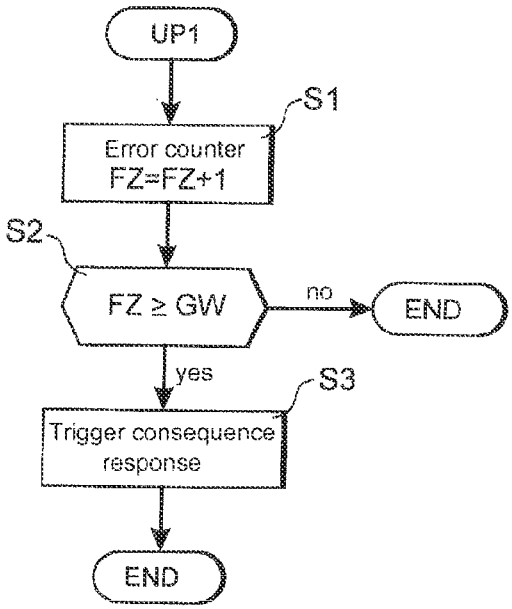
FIG. 8 shows a subroutine UP1.

FIG. 7 shows a program flowchart based on immediate deactivation of injection after initiation of the engine coastdown. This program flowchart corresponds to the speed curve nMOT1 in FIG. 6. At S1 an interrogation is made to determine whether an engine stop signal was detected. If this is not the case (interrogation result: no), then the program flowchart ends. If the operator required an engine stop, this is recognized as a predetermined operating state for calibration of the lambda sensor. At S2 an engine coastdown in then initiated by deactivating injection at S3 and setting a time window ZF at S4. At S5 a check is made to determine whether the engine speed nMOT is less than or equal to a threshold value GW=100 rpm. If the engine speed nMOT is still greater than the threshold value GW (interrogation result: no), then the program flows back to point A. If, on the other hand, it is determined at S5 that the engine speed nMOT is less than or equal to the threshold value (interrogation result: yes), then at S6 this time is set as the end of the time window ZF. Then at S7 a determination is made of the maximum pump current iP(MAX) that was detected within the time window ZF. At S8 a check is then made to determine whether the value of the maximum pump current iP(MAX) is within the tolerance range. If this is not the case (interrogation result: no), the program flows to a subroutine UP1 (FIG. 8). If the value of the maximum pump current iP(MAX) is permissible (interrogation result: yes), then the quotient Q of the maximum pump current iP(MAX) and the nominal pump current iP(NOM) of the lambda sensor that is being used, which is a constant value, is computed at S9. At S10 the quotient Q is then set as the calibration factor KAL. This ends the program flowchart for the determination of the calibration factor.

FIG. 8 shows a subroutine UP1, to which control passes when it is recognized at S8 in the program flowchart of FIG. 7 that the value of the determined maximum pump current iP(MAX) does not lie within the tolerance range. At S1 the content of the error counter FZ is increased by one, and at S2 a check is made to determine whether the count is greater than or equal to a limit GW. If this is not the case (interrogation result S2: no), then the subroutine and the main program (FIG. 7) end. If, on the other hand, it was determined at S2 that the value of the error counter FZ exceeds the limit GW (interrogation result: yes), a consequent response is triggered at S3, for example, the maximum pump current iP(MAX) is set to the value of the nominal pump current iP(NOM). The subroutine and the main program (FIG. 7) then end.

Figure 9:
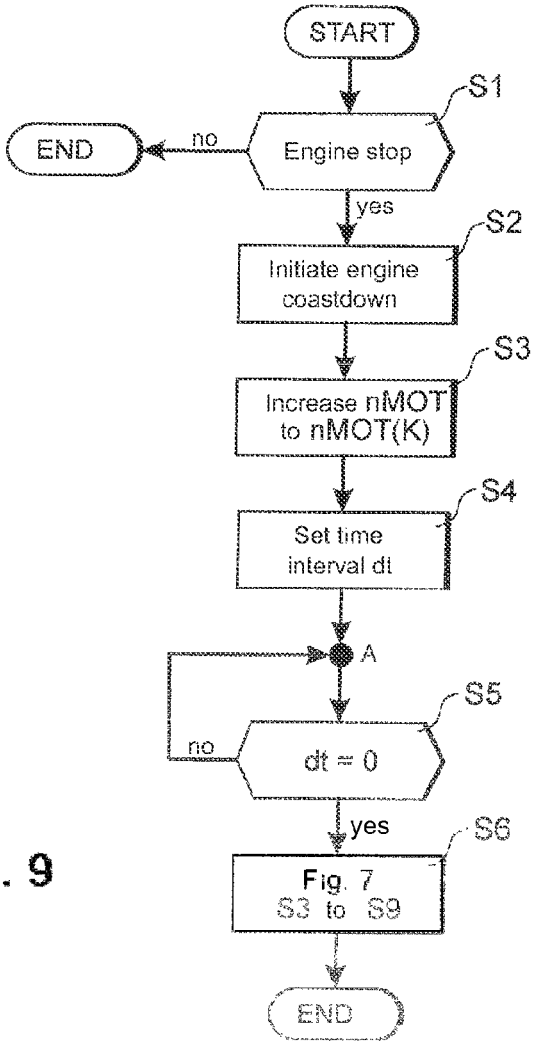
FIG. 9 shows a second program flowchart.

FIG. 9 shows program flowchart based on a temporary increase in the engine speed with subsequent deactivation of injection after initiation of the engine coastdown. This program flowchart corresponds to the speed curve nMOT2 in FIG. 6. At S1 an interrogation is made to determine whether an engine stop signal was detected. If this is not the case (interrogation result: no), then the program flowchart ends. If the operator required an engine stop, this is recognized as a predetermined operating state for calibration of the lambda sensor. At S2, therefore, an engine coastdown in initiated by first increasing the engine speed nMOT from the idling speed (FIG. 6: nLL) to the calibration speed nMOT(K), for example, nMOT(K)=1200 rpm, at S3 and then setting a time interval dt at S4. At S5 a check is then made to determine whether the time interval dt has elapsed. If it has not yet elapsed (interrogation result: no), then the program flows back to point A. If the time interval dt has elapsed (interrogation result: yes), the program passes through the same steps S3 to S9 described in connection with the program flowchart shown in FIG. 7, i.e., injection is deactivated, the time window ZF is set, the maximum pump current iP(MAX) is determined, and its value is tested for permissibility. The program flowchart then ends.

While specific embodiments of the invention have been shown and described in detail to illustrate the inventive principles, it will be understood that the invention may be embodied otherwise without departing from such principle.

We claim:

1. A method for automatic lambda control of an internal combustion engine, comprising the steps of: determining a calibration factor (KAL) upon detection of a predetermined operating state of the internal combustion engine based on pump current of a lambda sensor; correcting a lambda measuring signal (iP), during operation of the internal combustion engine, by the calibration factor (KAL) by multiplying the signal (iP) by the calibration factor (KAL); and setting the signal as an actual lambda value (Lam(IST)) for the automatic lambda control of the internal combustion engine, wherein the predetermined operating state is recognized when an engine coastdown is initiated.

2. The method in accordance with claim 1, including deactivating injection upon initiation of the engine coastdown.

3. The method in accordance with claim 1, including, upon initiation of the engine coastdown, first temporarily increasing engine speed (nMOT) from an idle speed (nLL) to a calibrating speed (nMOT(K)), and then, deactivating injection after expiration of a time interval (dt).

4. The method in accordance with claim 2, including, upon initiation of the engine coastdown, setting a time window (ZF), which ends when engine speed (nMOT) falls below a threshold value (GW) (nMOT<GW).

5. The method in accordance with claim 4, including, upon initiation of the engine coastdown, setting a time window (ZF), which ends when the engine speed (nMOT) falls below the threshold value (GW) (nMOT<GW) and a shut-off delay time (TN) has elapsed.

6. The method in accordance with claim 5, including determining a maximum value (iP(MAX)) of the lambda measuring signal (iP) within the time window (ZF).

7. The method in accordance with claim 3, including, upon initiation of the engine coastdown, setting a time window (ZF), which ends when the engine speed (nMOT) falls below a threshold value (GW) (nMOT<GW).

8. The method in accordance with claim 7, including, upon initiation of the engine coastdown, setting a time window (ZF), which ends when the engine speed (nMOT) falls below the threshold value (GW) (nMOT<GW) and a shut-off delay time (TN) has elapsed.

9. The method in accordance with claim 8, including determining a maximum value (iP(MAX)) of the lambda measuring signal (iP) within the time window (ZF).

10. A method for automatic lambda control of an internal combustion engine, comprising the steps of: determining a calibration factor (KAL) upon detection of a predetermined operating state of the internal combustion engine; correcting a lambda measuring signal (iP), during operation of the internal combustion engine, by the calibration factor (KAL); and setting the signal as an actual lambda value (Lam(IST)) for the automatic lambda control of the internal combustion engine, wherein the predetermined operating state is recognized when an engine coastdown is initiated, further including deactivating injection upon initiation of the engine coastdown and, upon initiation of the engine coastdown, setting a time window (ZF), which ends when engine speed (nMOT) falls below a threshold value (GW) (nMOT<GW) and, upon initiation of the engine coastdown, setting a time window (ZF), which ends when the engine speed (nMOT) falls below the threshold value (GW) (nMOT<GW) and a shut-off delay time (TN) has elapsed, further including determining a maximum value (iP(MAX)) of the lambda measuring signal (iP) within the time window (ZF), setting the maximum value (iP(MAX)) as a permissible value if the maximum value (iP(MAX)) lies within a tolerance range (TBD), and setting the maximum value (iP(MAX)) as an impermissible value if the maximum value (iP(MAX)) lies outside the tolerance range (TBD), and storing an impermissible maximum value (iP(MAX)) as an error in an error counter.

11. The method in accordance with claim 10, including comparing a maximum value (iP(MAX)) that is set as a permissible value with a nominal value (iP(NOM)) by taking a quotient, and setting the quotient (Q) as the calibration factor (KAL).

12. A method for automatic lambda control of an internal combustion engine, comprising the steps of: determining a calibration factor (KAL) upon detection of a predetermined operating state of the internal combustion engine; correcting a lambda measuring signal (iP), during operation of the internal combustion engine, by the calibration factor (KAL); and setting the signal as an actual lambda value (Lam(IST)) for the automatic lambda control of the internal combustion engine, wherein the predetermined operating state is recognized when an engine coastdown is initiated further including, upon initiation of the engine coastdown, first temporarily increasing engine speed (nMOT) from an idle speed (nLL) to a calibrating speed (nMOT(K)), and then, deactivating injection after expiration of a time interval (dt) and, upon initiation of the engine coastdown, setting a time window (ZF), which ends when the engine speed (nMOT) falls below a threshold value (GW) (nMOT<GW) including, upon initiation of the engine coastdown, setting a time window (ZF), which ends when the engine speed (nMOT) falls below the threshold value (GW) (nMOT<GW) and a shut-off delay time (TN) has elapsed and determining a maximum value (iP(MAX)) of the lambda measuring signal (iP) within the time window (ZF); including setting the maximum value (iP(MAX)) as a permissible value if the maximum value (iP(MAX)) lies within a tolerance range (TBD), setting the maximum value (iP (MAX)) as an impermissible value if the maximum value (iP(MAX)) lies outside the tolerance range (TBD), and storing an impermissible maximum value (iP(MAX)) as an error in an error counter.

13. The method in accordance with claim 12, including comparing a maximum value (iP(MAX)) that is set as a permissible value with a nominal value (iP(NOM)) by taking a quotient, and setting the quotient (Q) as the calibration factor (KAL).

* * * * *